United States Patent [19]

Spencer

[11] 4,138,054

[45] Feb. 6, 1979

[54] CONTAINER FORMED FROM BAGS HAVING INSERTS

[76] Inventor: Neil E. Spencer, 524 W. Maple St., North Canton, Ohio 44720

[21] Appl. No.: 865,232

[22] Filed: Dec. 27, 1977

[51] Int. Cl.[2] ..... B65D 5/32

[52] U.S. Cl. ..... 229/23 BT; 229/55

[58] Field of Search ..... 229/55, 23 BT, 16 R

[56] References Cited

U.S. PATENT DOCUMENTS

| | | | |
|---|---|---|---|
| 1,486,234 | 3/1924 | Dickey | 229/55 |
| 1,701,097 | 2/1929 | Broderick | 229/55 UX |
| 1,907,172 | 5/1933 | Anzet | 229/55 X |
| 2,138,700 | 11/1938 | Hoffbro | 229/55 X |
| 2,494,177 | 1/1950 | Hultin | 229/55 X |
| 2,802,617 | 8/1957 | Roper | 229/55 |
| 2,937,744 | 5/1960 | Olson | 229/55 X |
| 3,130,896 | 4/1964 | Mack | 229/55 |
| 3,157,345 | 11/1964 | George | 229/23 BT |
| 3,973,356 | 8/1976 | Schacht | 229/23 BT X |

*Primary Examiner*—Davis T. Moorhead
*Attorney, Agent, or Firm*—Michael Williams

[57] ABSTRACT

The invention relates to means for and methods of forming containers. The means comprises one or more pieces of corrugated cardboard adapted to be inserted into standard bags usually provided by stores for carrying purchased commodities. A cardboard piece is bent along scored lines to a form wherein it will fit within the bag to shape the latter widthwise, the excess upper portion of the bag being folded into the bag and over the cardboard piece to form a container. Another corrugated cardboard piece, if a different width than the first mentioned piece, is bent along score lines to a form wherein it will fit within another grocery bag to shape the latter endwise, the excess upper portion of the bag being folded into the bag and over the cardboard piece to form a container. One of the containers may be inserted into the other to form a dust-proof storage box or a shipping container.

10 Claims, 11 Drawing Figures

CONTAINER FORMED FROM BAGS HAVING INSERTS

BACKGROUND AND SUMMARY

The prior art contains various forms of inserts for bags to stiffen and shape the same. However, such prior art inserts are either relatively expensive to manufacture, or difficult to insert into a bag, or are adhered to the bag to form a part thereof.

In contrast, the insert of my invention comprises an inexpensive blank formed of a rigid material, such as corrugated cardboard, having a pair of score lines whereby the blank may be formed to a U-shape and thus adapted to be inserted into an ordinary grocery bag with the bight of the U lowermost. The top of the bag may be folded inward to form a container.

In a preferred embodiment of my invention, two containers are formed as above described, with one insert shaping a bag widthwise and another insert shaping another bag endwise, and in each case the upper portion of the bag is folded inwardly to complete the container. One container is adapted to be inserted within the other container to form a storage or shipping box.

DESCRIPTION OF THE DRAWINGS

In the drawings accompanying this specification and forming a part of this application there is shown, for purpose of illustration, an embodiment which my invention may assume, and in these drawings.

DESCRIPTION OF THE PREFERRED EMBODIMENT

My invention is adapted to utilize standard-sized bags, such as the 12inch (32 centimeters) wide bags used by grocery and like stores to contain groceries or other commodities purchased by a customer. Usually, after the customer removes the contents of the bag, the latter is discarded, and this represents an unnecessary waste. Through use of such standard-sized bags, in combination with inserts of rigid material, such as corrugated cardboard, the bags are inexpensively transformed into containers for storing various articles.

Figure 1:
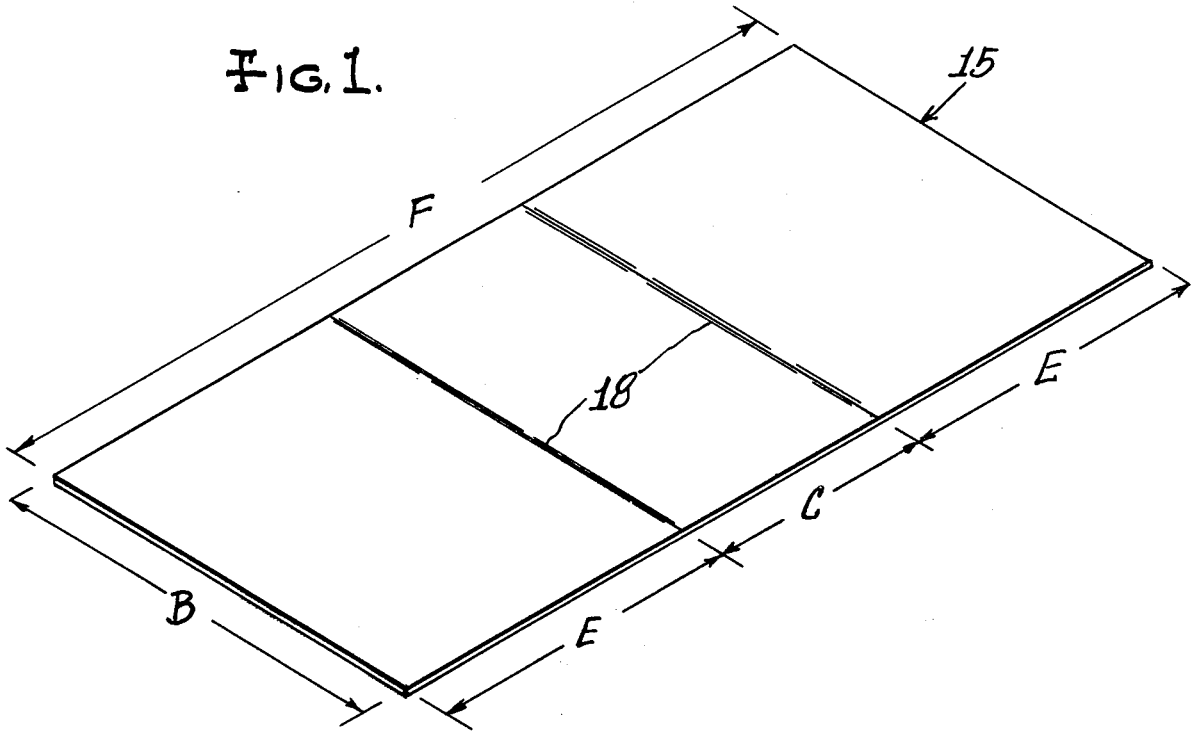
FIGS. 1 and 2 are perspective views of inserts for use in my invention.
Figure 2:
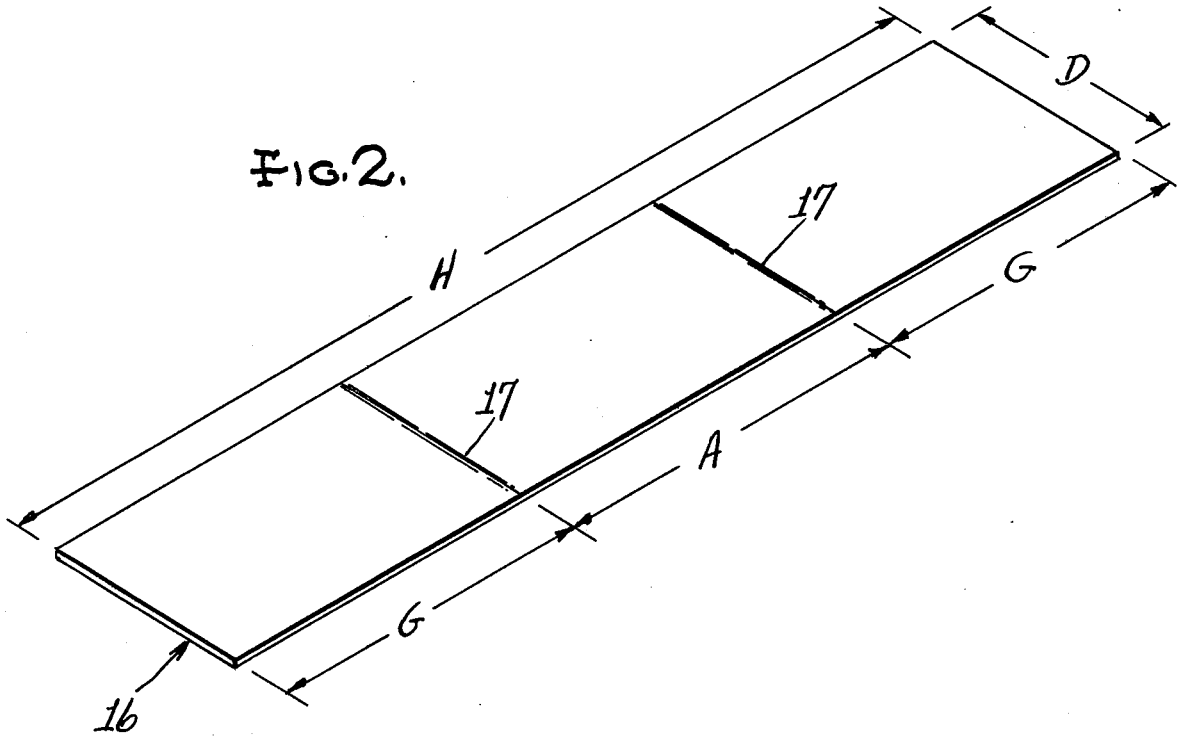

With reference to FIGS. 1 and 2, two bag inserts 15 and 16 are shown, each formed of a rigid material, such as low-cost corrugated cardboard, although any other suitable rigid material may be used, such as plastic or the like. The insert 16 is longer but narrower than the insert 15, for a purpose to be disclosed.

The insert 16 between the marginal edges of the longer sides has a pair of transverse score lines 17—17 at its intermediate portion, the distance "A" between these score lines being substantially equal to the width "B" of the insert 15. The insert 15 between the marginal edges of the longer sides has a pair of transverse score lines 18—18 in its intermediate portion, the distance "C" between such score lines being preferably slightly greater than the width "D" of the insert 16.

Figure 3:
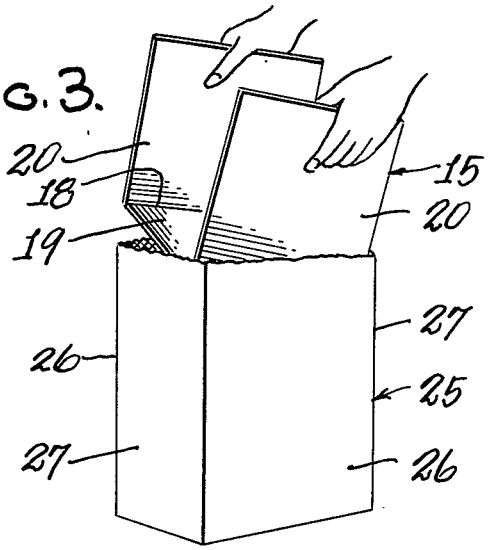
FIG. 3 is a perspective view showing the formed insert of FIG. 1 being inserted within a bag.
Figure 5:
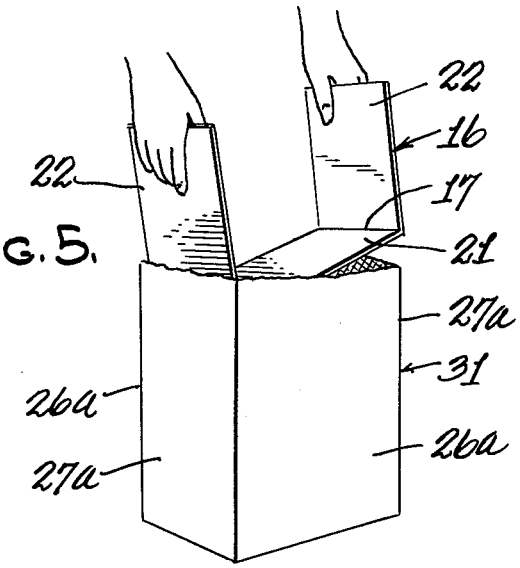
FIG. 5 is a perspective view showing the formed insert of FIG. 2 being inserted into a bag.

The insert 15 is adapted to be folded along its score lines 18—18 to a U-shape, as seen in FIG. 3, to form a generally flat bottom portion 19 and a pair of legs 20—20. The insert 16 is also adapted to be folded along its score lines 17—17 to a U-shape, as seen in FIG. 5, to form a generally flat bottom 21 and a pair of legs 22—22. Preferably, the legs 20 of the insert 15 are substantially the same length as the legs 22 of the insert 16, but such lengths may differ.

Figure 4:
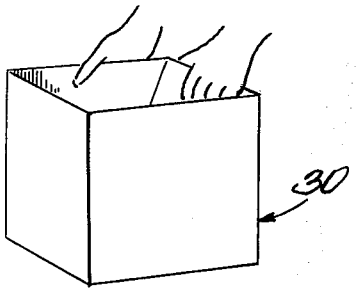
FIG. 4 is a perspective view showing the upper portion of the bag being folded inwardly.

After the insert 15 is formed to U-shape, it may be inserted into the open end of a grocery bag 25 in the manner shown in FIG. 3. The bag 25 has a pair of side walls 26—26 which are spaced substantially equal to distance "C" of the insert 15 and a pair of end walls 27—27 which are spaced substantially equal to the distance "B" of the insert 15, so that the formed insert may be readily disposed through the open end of the bag 25 to a position wherein its flat bottom portion 19 will engage the inside of the flat bottom of the bag, with the area and outline of the bottom portion 19 substantially equal to the area and outline of the bottom of the bag. The walls of the bag 25 are of a longer length than the length of the insert legs 20—20 and the upper portion of the bag is tucked in to overlie the legs 20—20 for a considerable distance as shown in FIG. 4. The length of the insert legs 20 determine the depth of the container 30 formed by the foregoing assembly.

After the insert 16 is formed to U-shape, it may be inserted into the open end of another grocery bag 31 in the manner shown in FIG. 5. The bags 25 and 31 are preferably of the same standard size, and have similar side and end walls, the walls of the bag 31 being given the same reference numerals as the bag 25, but with the suffix "a" added.

Figure 6:
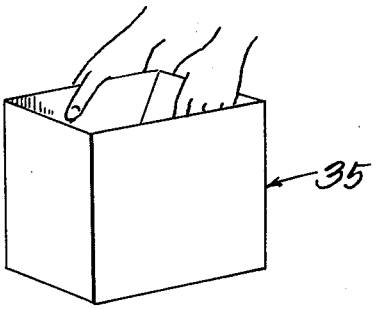
FIG. 6 is a perspective view showing the upper portion of the bag of FIG. 5 being folded inwardly.

The width "D" of the insert 16 is substantially equal to the space between the side walls *26a—26a*, and the distance "A" is substantially equal to the space between the end walls *27a—27a*, so that the formed insert 16 may be readily disposed through the open end of the bag 31 to a position wherein its generally flat bottom portion 21 will engage the inside of the flat bottom of the bag 31, with the area and outline of the bottom portion 21 substantially equal to the area and outline of the bag bottom. The upper end of the bag is then tucked in, as suggested in FIG. 6 to overlie the legs 22—22 a substantial amount. The foregoing assembly provides a second container 35 having a depth substantially equal to the depth of the contaner 30.

When standard 12 inch wide grocery bags are used, I have found it preferable to form the inserts 15 and 16 to approximately the following dimensions: with respect to the insert 15, dimension B equal to 11 $\frac{3}{4}$ inches (30 centimeters), dimension C equal to 6 $\frac{5}{8}$ inches (17 centimeters), dimensions E equal to 9 $\frac{1}{8}$ inches (23 centimeters) with the overall dimension F adding up to 24 $\frac{7}{8}$ inches (109 centimeters); and with respect to the insert 16, dimension A equal to 11 ¾ inches (30 centimeters), dimension D equal to 6 ¼ inches (16 centimeters), dimensions G equal to dimensions E, namely, 9 ⅛ inches (23 centimeters), with the overall dimension H adding up to 30 inches (76 centimeters).

Figure 7:
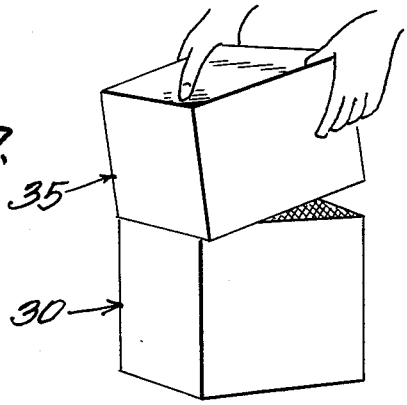
FIG. 7 is a perspective view showing insertion of one container within the other to form a storage or shipping box.

Either container 30, 35 may be inserted open-end first through the open end and into the other container since the bag walls of such container may be flexed enough to provide for such assembly. FIG. 7 shows the container 35 in the process of being applied over the container 30, and when one container is completely within the other, a storage or shipping box is formed which is quite sturdy since the insert legs 20—20 and 22—22 form rigid supports for the four walls of the storage box. The depth of the storage box may be varied by inserting one container into the other different amounts. Since the storage boxes are quite rigid, they may be placed one on top the other to conserve storage space.

Figure 8:
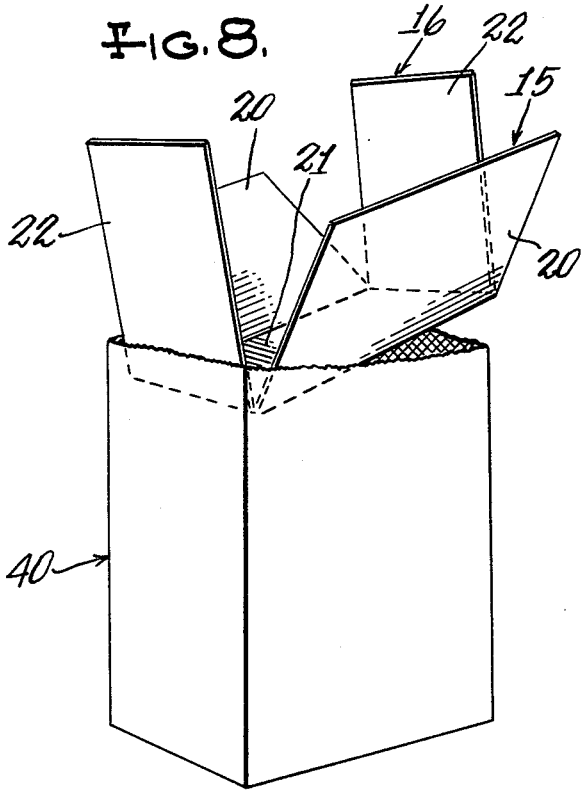
FIG. 8 is a perspective view of the inserts of FIGS. 1 and 2 arranged for use with a single grocery bag.

As seen in FIG. 8 the two inserts 15 and 16 may be disposed crosswise of each other, with the bottom portion of one engaging the bottom portion of the other. As shown, the bottom portion 21 of the insert 16 overlies the bottom portion 19 of the insert 15, although these may be reversed. The combined inserts may be inserted into the open end of a paper bag 40 which is preferably of the same size as the bags hereinbefore referred to. The upper end of the bag 40 is tucked inwardly to overlie substantial portions of the legs 20—20 and 22—22 to form a container having four fairly rigid sides.

Figure 9:
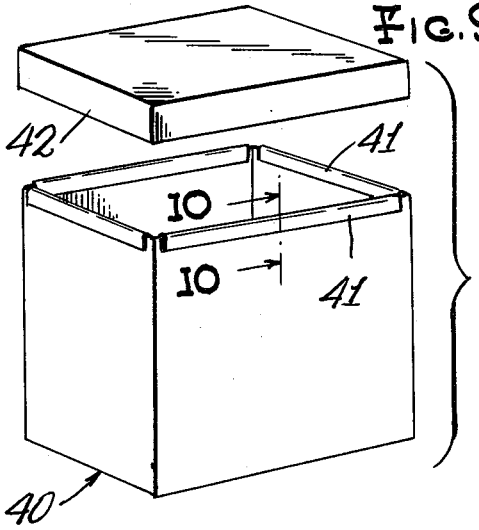
FIG. 9 is a perspective view of a container resulting from the disposition of parts shown in FIG. 8, with a cover in separated relation.
Figure 10:
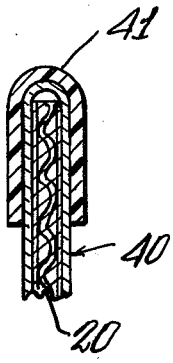
FIG. 10 is an enlarged, fragmentary sectional view corresponding to the line 10—10 of FIG. 9.

To further increase rigidity and to improve appearance, stiffening means may be applied to the upper edges of the container formed in the manner of FIG. 8. As shown in FIGS. 9 and 10, lengths of plastic strips 41 may be added to the upper edges, each strip having a U-shaped cross-section, as seen in FIG. 10, to frictionally fit over an upper edge. A cover 42 may be provided to closely fit over the strips 41 and, if desired, the cover may be made of a clear plastic material.

Figure 11:
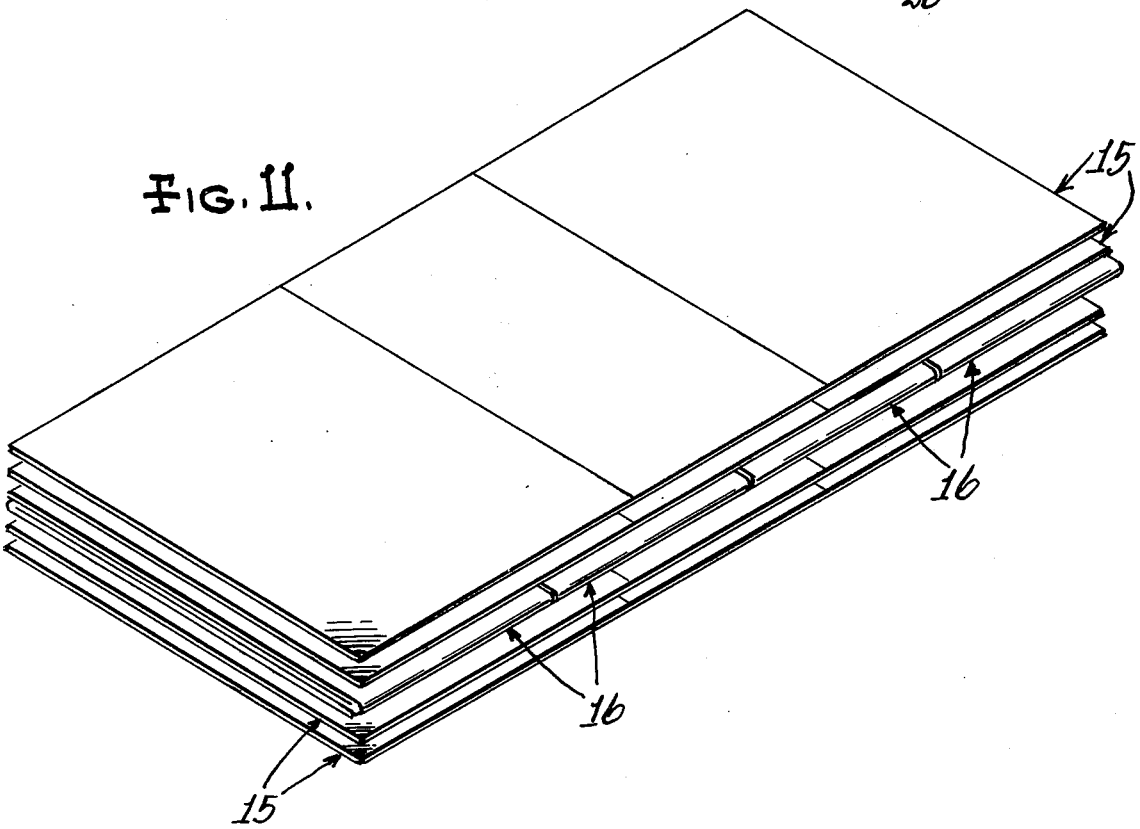
FIG. 11 is a perspective view showing a method of packing a plurality of inserts for shipment.

The inserts 15 and 16 are of a size that provides for economical and ideal packaging. As shown in FIG. 11, four inserts 16 are arranged in a Z-shape flat folded condition and are adapted to be sandwiched between four unfolded inserts 15 with two inserts 15 preferably on opposite sides of the transversely arranged inserts 16. It will be appreciated that the inserts may be folded other than a Z-fold, so long as the portions thereof closely overlie each other for flat disposition between the inserts 15.

This provides a very flat package, and a sheet (not shown) may be wrapped around the inserts to form and maintain the flat package. At the present time, a very thin, clear plastic sheet is shrink-wrapped about the package. The package shown in FIG. 11 will provide enough inserts 15 and 16 to make four storage boxes of the type shown in FIG. 7, or four containers of the type shown in FIG. 9.

I claim:

1. A container, comprising:

a flat-bottom bag of flexible material and oblong in cross-section, and an insert formed from planar relatively rigid material, said insert having elongated sides terminating in marginal edges defining a width substantially equal to the width of two opposite walls of said bag, said insert being folded to U-shape to provide a relatively flat bight and legs extending in substantially equal amounts from opposite ends of said bight, to define three flat panels between said marginal edges, said insert being disposed within said bag to a position wherein said bight overlies the inside surface of the bottom of said bag, and said leg panels lie along the inside surfaces of respective ones of said opposite bag walls, the remaining two opposite walls of said bag being substantially free of contact with said insert, thereby to reinforce said two opposite walls and the bottom of said bag.

2. The construction according to claim 1 wherein a said bag is of a height that is longer than the length of said insert legs, and the top portion of said bag being tucked within the bag with the portions thereof adjacent an insert lying along the inwardly disposed surfaces of said insert legs.

3. The construction according to claim 1 wherein said bag is a standard paper bag which is normally furnished by stores for customers to carry purchased commodities.

4. The construction according to claim 3 wherein a said insert is formed of corrugated cardboard and has a pair of score lines about which said insert is formed to U shape

5. The container of claim 1 further including a second flat-bottom bag of thin flexible material and oblong in cross-section with dimensions substantially corresponding to said first-mentioned bag, and, an insert for said second bag formed from planar relatively rigid material and having elongated sides terminating in marginal edges defining a width substantially equal to the width of said remaining two opposite walls of said first-mentioned bag, said second bag insert being folded to U-shape and disposed within said second bag to a position overlying the inside surface of the bottom of said second bag and the inside surfaces of respective opposite bag walls which correspond in dimension substantially to said remaining two opposite walls of said first-mentioned bag.

6. The container of claim 5 wherein said two bags and respective inserts are telescoped with the open end of one bag inserted within the open end of the other bag and with said respective inserts interdigitated thereby to form a closed six-sided container having insert panels reinforcing the bags on all walls and bottoms thereof.

7. The container of claim 1 further including a second U-folded insert of like construction having elongated sides terminating in marginal edges defining a width substantially equal to the width of said remaining two opposite walls of said bag, and inserted therein crosswise with respect to the first-mentioned insert to overlie the bottom of the first insert and with the leg panels of said second insert disposed along the inside surfaces of said two remaining walls of said bag.

8. The container of claim 7 further including U-shaped stiffening strips applied to and fitting over the upper edges of the bag.

9. The construction according to claim 5 wherein a said bag is of a height that is longer than the length of said insert legs, and the top portion of said bag being tucked within the bag with the portions thereof adjacent an insert lying along the inwardly disposed surfaces of said insert legs.

10. The construction according to claim 5 wherein said bags are standard paper bags normally furnished by stores to customers to carry purchased commodities.

* * * * *